US009206713B2

(12) United States Patent
Schafer et al.

(10) Patent No.: US 9,206,713 B2
(45) **Date of Patent: *Dec. 8, 2015**

(54) ARRANGEMENT OF A VOLUME ACCUMULATOR

(71) Applicant: Schaeffler Technologies AG & Co. KG, Herzogenaurach (DE)

(72) Inventors: Jens Schafer, Herzogenaurach (DE); Martin Steigerwald, Herzogenaurach (DE); Michael Busse, Herzogenaurach (DE); Jurgen Plate, Gerhardshofen (DE); Andreas Wedel, Emskirchen (DE); Olaf Boese, Nuremberg (DE); Steffen Racklebe, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 64 days.

This patent is subject to a terminal disclaimer.

(21) Appl. No.: 13/746,609

(22) Filed: Jan. 22, 2013

(65) Prior Publication Data

US 2013/0199470 A1 Aug. 8, 2013

(30) Foreign Application Priority Data

Feb. 2, 2012 (DE) ..... 10 2012 201 566

(51) Int. Cl.
*F01L 1/34* (2006.01)
*F01L 1/344* (2006.01)

(52) U.S. Cl.
CPC ..... *F01L 1/3442* (2013.01); *F01L 2001/34433* (2013.01); *F01L 2001/34446* (2013.01)

(58) Field of Classification Search
CPC .. F01L 1/34; F01L 1/3442; F01L 2001/34446
See application file for complete search history.

(56) References Cited

U.S. PATENT DOCUMENTS

| | | | | |
|---|---|---|---|---|
| 6,035,819 | A | 3/2000 | Nakayoshi et al. | |
| 7,222,597 | B2 * | 5/2007 | Auchter et al. | 123/90.17 |
| 8,776,747 | B2 * | 7/2014 | Schafer et al. | 123/90.17 |
| 2012/0111295 | A1 * | 5/2012 | Plate et al. | 123/90.15 |
| 2013/0199476 | A1 * | 8/2013 | Schafer et al. | 123/90.17 |

FOREIGN PATENT DOCUMENTS

| | | |
|---|---|---|
| DE | 19903624 | 8/1999 |
| DE | 102004028868 | 1/2006 |
| DE | 102009042202 | 4/2011 |
| WO | 2011032805 | 3/2011 |

* cited by examiner

*Primary Examiner* — Daniel Bernstein
(74) *Attorney, Agent, or Firm* — Volpe and Koenig, P.C.

(57) ABSTRACT

A stator (20) for a camshaft adjuster (4). The stator (20) has an outer part (50) for concentrically holding a rotor (22) with vanes (34) arranged around the rotor (22) and a segment (52) projecting from the outer part (50) for engaging between two vanes (34) of the rotor (22), in order to form, together with the two vanes (22), pressure chambers (44) of the camshaft adjuster (4). Here, the segment (52) has a cavity (70) for holding a hydraulic fluid from the pressure chambers (44).

10 Claims, 5 Drawing Sheets

ARRANGEMENT OF A VOLUME ACCUMULATOR

INCORPORATION BY REFERENCE

The following documents are incorporated herein by reference as if fully set forth: German Patent Application No. 10 2012 201 566.3, filed Feb. 2, 2012.

FIELD OF THE INVENTION

The invention relates to a stator for a camshaft adjuster, the camshaft adjuster, and an internal combustion engine with the camshaft adjuster.

BACKGROUND

Camshaft adjusters are technical assemblies for adjusting the phase positions between a crankshaft and a camshaft in an internal combustion engine.

From WO 2011 032 805 A1, it is known to arrange a volume accumulator in a camshaft adjuster, wherein, in the case of an under-pressure, hydraulic fluid can be drawn from this accumulator by the pressure chambers.

SUMMARY

The object of the invention is to improve the known camshaft adjusters.

This objective is met by the features of the invention. Preferred improvements are described below and in the claims.

The invention provides forming the volume accumulator in the stator of the camshaft adjuster.

This is based on the idea that the stator of a camshaft adjuster has segments that form the pressure chambers together with the vanes of the rotor of the camshaft adjuster. These segments can have hollow constructions, for example, for saving material and weight.

However, the invention is also based on the knowledge that the cavities of these segments are usually not functionally utilized. The use of these cavities as volume accumulators would therefore impart an additional function to these segments, without requiring great increases in the installation space of the camshaft adjuster.

The invention therefore provides a stator for a camshaft adjuster that comprises an outer part for concentrically holding a rotor with vanes arranged on the rotor and a segment projecting from the outer part for engaging between two vanes of the rotor, in order to form pressure chambers of the camshaft adjuster together with the two vanes. Here, the segment has a cavity for holding a hydraulic fluid from the pressure chambers. The outer part can have, in particular, a ring shape, wherein the segments project inward in the radial direction. The vanes can be arranged around the rotor and project away from this rotor in the radial and/or axial direction. The cavity in the segment thus can be used as a volume accumulator that holds hydraulic fluid coming from the pressure chamber via a corresponding supply port, wherein, in the case of an under-pressure, the pressure chamber can draw the discharged hydraulic fluid via a discharge port connected to the pressure chamber.

In one refinement of the invention, the stator has a front cover placed on the ring-shaped outer part in the axial direction and/or a back cover placed on the ring-shaped outer part in the axial direction. These covers close an interior space of the ring-shaped outer part of the stator and allow the pressure chambers to be defined with the vanes of the rotor.

In an alternative construction of the invention, the cavity in the indicated stator can be formed, instead of in the segment, also in one of the two covers or in both covers.

In an additional refinement, a supply line for supplying the cavity with hydraulic fluid is guided from the pressure chambers through the front cover and/or through the back cover. Because the covers are already locked in rotation with the stator, the supply of the cavity with the hydraulic fluid can be implemented in a technically very favorable way.

In one alternative or additional refinement of the invention, a discharge line for bleeding hydraulic fluid from the cavity is guided through the front cover and/or through the back cover. In this way, the volume accumulator formed by the cavity can be connected via the discharge line directly to the tank connection of the camshaft adjuster.

In another refinement of the invention, the specified stator comprises a pressure equalization line between the cavity and an outer side of the segment directed in the peripheral direction for supplying the pressure chamber with the hydraulic fluid, so that the pressure chamber can draw hydraulic fluid from the pressure chamber.

In one special refinement of the invention, the indicated stator comprises a non-return valve in the pressure equalization line that allows a flow of hydraulic fluid from the cavity, in order to balance an under-pressure in one of the pressure chambers. In this way, a flow of hydraulic fluid from the pressure chamber into the volume accumulator is prevented when the pressure in the pressure chamber is greater than that in the volume accumulator. The non-return valve thus makes sure that the volume accumulator is used only for equalizing an under-pressure in the pressure chamber.

The invention also provides a camshaft adjuster for setting a phase shift between a crankshaft driven by an internal combustion engine and a camshaft controlling the internal combustion engine. The indicated camshaft adjuster comprises an indicated stator for transferring rotational energy from the crankshaft and a rotor held concentrically in the stator for receiving the rotational energy to the camshaft. Through the indicated stator, the indicated camshaft adjuster can be formed with more functions and with a comparatively low increase in installation space.

In one refinement of the invention, the indicated camshaft adjuster comprises a central valve for connecting at least one pressure chamber formed between the rotor and the stator to the cavity in the segment of the stator. The central valve thus makes sure that the pressure chamber is either filled with hydraulic fluid from a pressure connection or is emptied via the volume accumulator.

The invention also provides an internal combustion engine that comprises a combustion chamber, a crankshaft driven by the combustion chamber, a camshaft for controlling the combustion chamber, and an indicated camshaft adjuster for transferring rotational energy from the crankshaft to the camshaft.

BRIEF DESCRIPTION OF THE DRAWINGS

Embodiments of the invention will be explained in more detail below with reference to a drawings in which.

DETAILED DESCRIPTION OF THE PREFERRED EMBODIMENTS

In the figures, identical elements are provided with identical reference symbols and will be described only once.

Figure 1:
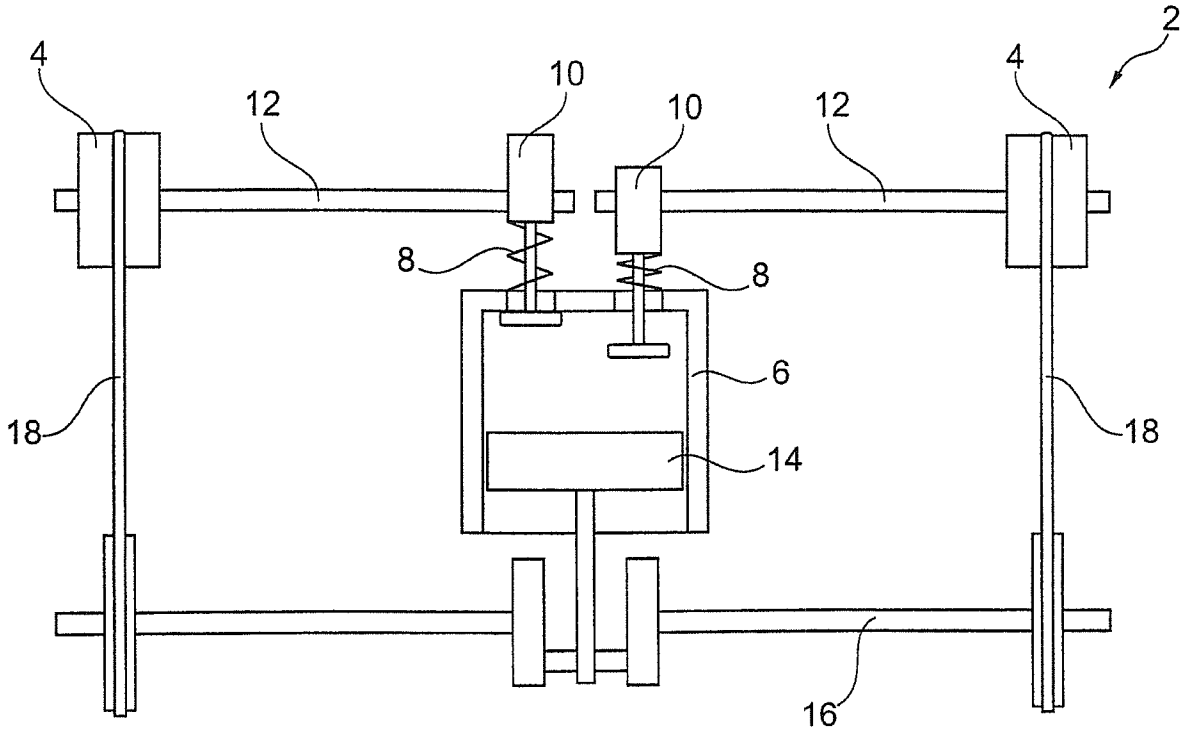
FIG. 1 is a schematic diagram of an internal combustion engine with camshaft adjusters.

FIG. 1 will be referenced that shows a schematic diagram of an internal combustion engine 2 with camshaft adjusters 4.

In a known way, the internal combustion engine 2 comprises a combustion chamber 6 that can be opened and closed by valves 8. The valves are driven by cams 10 on corresponding camshafts 12. In the combustion chamber 6, a reciprocating piston 14 is also held that drives a crankshaft 16. The rotational energy of the crankshaft 16 is transferred on its axial end via driving means 18 to the camshaft adjuster 4.

The camshaft adjusters 4 are each placed axially on one of the camshafts 12, receive the rotational energy from the driving means 18, and transfer this energy to the camshafts 12. Here, the camshaft adjusters 4 can delay or accelerate the rotation of the camshafts 12 relative to the crankshaft 14 in terms of time, in order to change the phase position of the camshafts 12 relative to the crankshaft 16.

Figure 2:
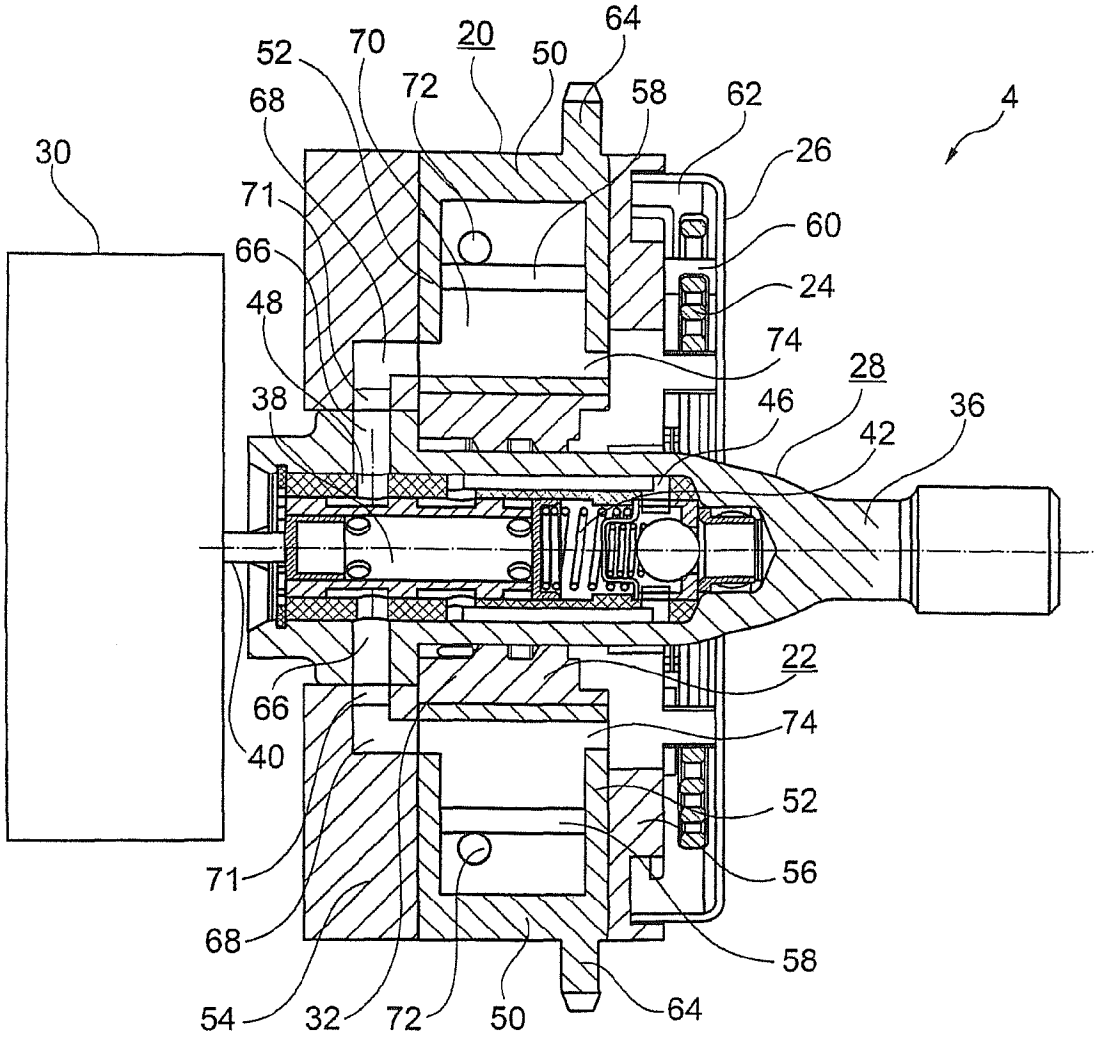
FIG. 2 is a section view of a camshaft adjuster from FIG. 1 with a stator.

FIG. 2 will be referenced that shows a section view of one of the camshaft adjusters 4 from FIG. 1 with a stator 20.

In addition to the stator 20, the camshaft adjuster 4 has a rotor 22 held in the stator 20, a spiral spring 24 biasing the stator 20 relative to the rotor 22, a spring cover 26 covering the spiral spring, a central valve 28 held centrally in the camshaft adjuster 4, and a central magnet 30 actuating the central valve 28.

Figure 3:
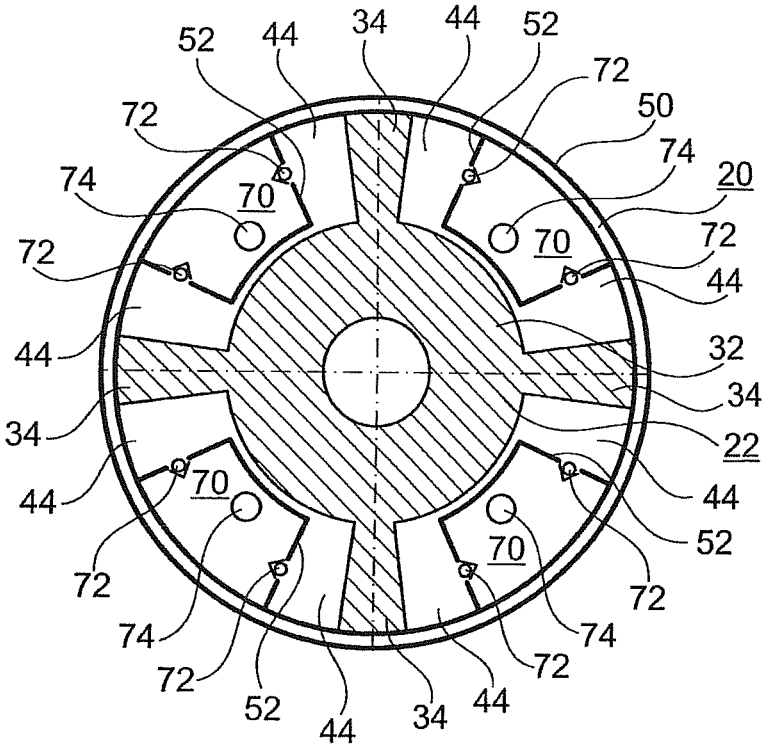
FIG. 3 is a section view of an example for the stator from FIG. 2.
Figure 4:
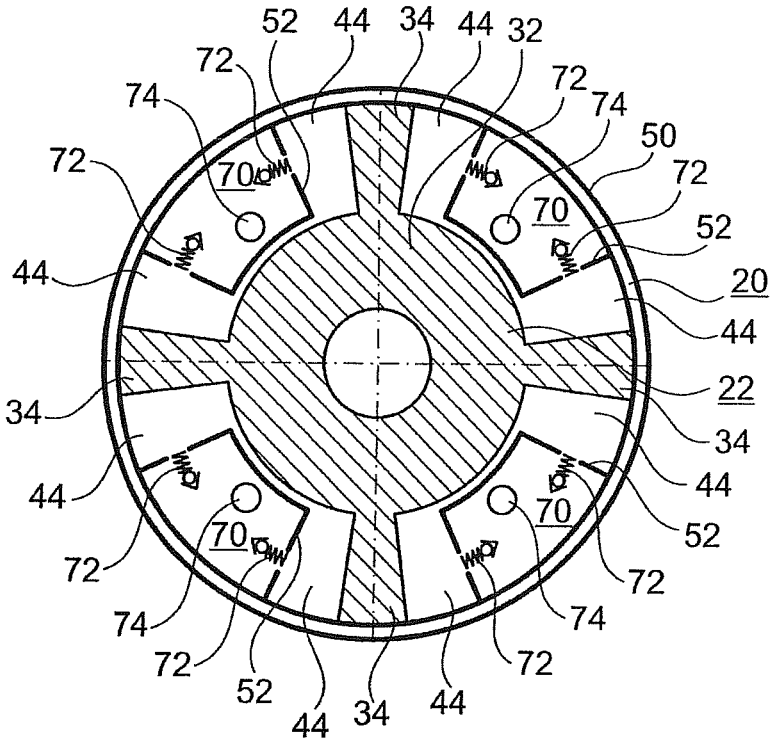
FIG. 4 is a section view of another example for the stator from FIG. 2.
Figure 5:
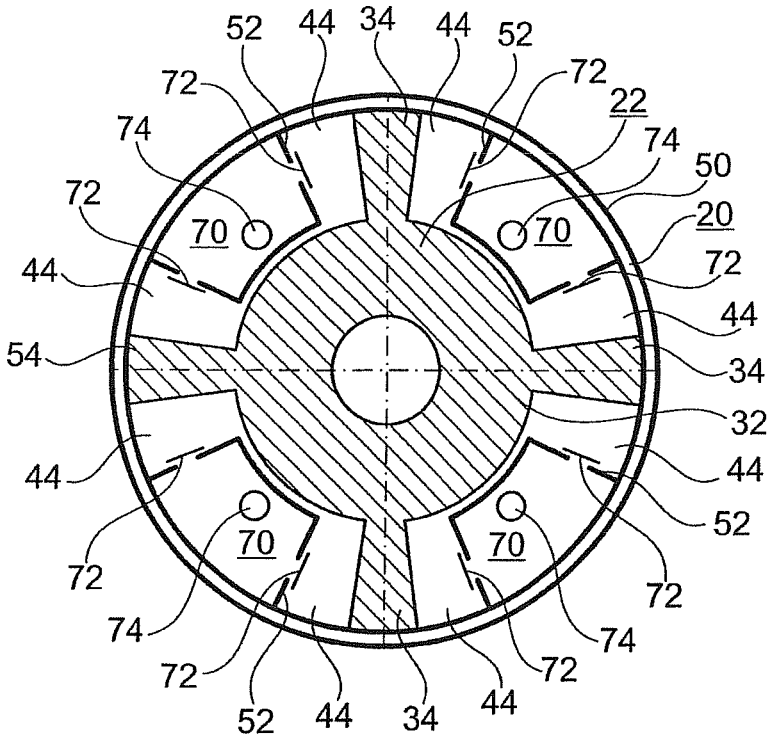
FIG. 5 is a section view of yet another example for the stator from FIG. 2.

The rotor 22 is held concentrically in the stator 20 and has, shown in FIGS. 3 to 5, vanes 34 projecting from a hub 32 of the rotor. The rotor 22 is held concentrically on a central screw 36 of the central valve 28 that can be screwed into one of the camshafts 12 and in which a control piston 38 is held so that it can move in the axial direction and can be moved by a tappet 40 of the central magnet in the axial direction into the central screw 36 and can be pressed outward from the central screw 36 by a spring 42 in the axial direction. Depending on the position of the control piston 38 in the central screw 36, pressure chambers 44 of the camshaft adjuster 4 shown in FIGS. 3 to 5 are connected in a known way to a pressure connection 46 or to a volume accumulator connection 48 by which a hydraulic fluid can be pumped out into the pressure chambers 44 or can be bled from these chambers.

The stator 20 has a ring-shaped outer part 50 that can be seen well in FIGS. 3 to 5, with four segments 52 projecting inward in the radial direction from this outer part. The ring-shaped outer part 50 is closed in the axial direction with a front cover 54 and a back cover 56, wherein the covers 54, 56 are held on the ring-shaped outer part 50 by screws 58. One of the screws 58 has an axial extension 60 that is used as a mounting point for the spiral spring 24. A peripheral groove 62 is further formed in the back cover 56 on the axial side opposite the ring-shaped outer part 50. The spring cover 26 is clamped in this peripheral groove. Teeth 64 in which the driving means 18 can engage are formed on the radial periphery of the ring-shaped outer part 50.

The central screw 36 has radial holes 66 as volume accumulator connections 48, with axial channels 68 through the front cover 54 being placed on these holes. The channels 68 are set in the radial direction on a peripheral groove 71 on the radial inner side of the front cover 54 directed toward the central screw 36, in order to allow a flow of hydraulic fluid in any position of the central screw 36 locked in rotation with the rotor 22 relative to the stator 20 between the radial holes 66 and the channels 68.

The channels 68 lead into cavities 70 that are formed in the segments 52 and through which the screws 58 are also guided. The cavities 70 are opened by non-return valves 72 to the pressure chambers 44 of the camshaft adjuster 4, wherein the flow of hydraulic fluid is possible only from the cavity 70 to the pressure chamber 44, so that the pressure chamber 44 can draw hydraulic fluid stored in the cavity 70 in the case of an under-pressure. If the cavity 70 is overflowing with too much hydraulic fluid, then the excess of hydraulic fluid is discharged via a tank connection 74, for example, to a not-shown oil pan. The cavities 70 in the segments 52 are therefore used as volume accumulators for equalizing an under-pressure in the pressure chambers 44 of the camshaft adjuster 4 of the internal combustion engine 2.

FIG. 3 will be referenced that shows a section view of an example for the stator from FIG. 2.

As can be seen from FIG. 3, the non-return valves 72 can be constructed, for example, as ball non-return valves.

FIG. 4 will be referenced that shows a section view of another example for the stator from FIG. 2.

As can be seen from FIG. 4, the balls of the non-return valves 72 can be held in the non-return valves 72 by springs. In this way, the dynamic response of the non-return valves 72 can be increased during the opening and/or closing of the non-return valves 72.

FIG. 5 will be referenced that shows a section view of yet another example for the stator from FIG. 2.

As can be seen from FIG. 5, the non-return valves 72 can be constructed, for example, as plate non-return valves. In this way, the non-return valves can be installed in the camshaft adjuster 4 with a particularly small amount of installation space.

In the present construction, the cavities 70 are constructed in the segments 52. Alternatively or additionally, the cavities 70 could also be formed in the covers 54, 56. Accordingly, the described supply lines or discharge lines for the hydraulic fluid are then alternatively or additionally guided through the covers, wherein the non-return valves are then alternatively or additionally also to be mounted on the covers.

LIST OF REFERENCE NUMBERS

2 Internal combustion engine
4 Camshaft adjuster
6 Combustion chamber
8 Valve
10 Cam
12 Camshaft
14 Reciprocating piston
16 Crankshaft
18 Driving means
20 Stator
22 Rotor
24 Spiral spring
26 Spring cover
28 Central valve
30 Central magnet
32 Hub
34 Vane
36 Central screw
38 Control piston
40 Tappet
42 Spring

44 Pressure chamber
46 Pressure connection
48 Volume accumulator connection
50 Ring-shaped outer part
52 Segment
54 Front cover
56 Back cover
58 Screw
60 Axial extension
62 Groove
64 Tooth
66 Radial hole
68 Channel
70 Cavity
71 Peripheral groove
72 Non-return valve
74 Tank connection

The invention claimed is:

1. A stator for a camshaft adjuster comprising a ring-shaped outer part for concentrically holding a rotor with vanes arranged on the rotor and a segment projecting from the outer part for engaging between two vanes of the rotor, in order to form, together with the two of the vanes, pressure chambers of the camshaft adjuster, the segment includes a cavity located therein for holding hydraulic fluid from the pressure chambers.

2. The stator according to claim 1, further comprising a front cover placed on the ring-shaped outer part.

3. The stator according to claim 2, further comprising a back cover placed on the ring-shaped outer part.

4. The stator according to claim 3, wherein a supply line for supplying the cavity with hydraulic fluid from the pressure chambers is guided through at least one of the front cover or the back cover.

5. The stator according to claim 3, wherein a discharge line for bleeding the hydraulic fluid from the cavity is guided through at least one of the front cover or the back cover.

6. The stator according to claim 1, further comprising a pressure equalization line between the cavity and an outer side of the segment directed in a peripheral direction for supplying the pressure chamber with the hydraulic fluid.

7. The stator according to claim 6, further comprising a non-return valve in the pressure equalization line that allows a flow of hydraulic fluid from the cavity, in order to equalize an under-pressure in one of the pressure chambers.

8. A camshaft adjuster for setting a phase shift between a crankshaft driven by an internal combustion engine and a camshaft controlling the internal combustion engine, comprising a stator according to claim 1 for receiving rotational energy from the crankshaft and a rotor held concentrically in the stator for transferring the rotational energy to the camshaft.

9. The camshaft adjuster according to claim 8, further comprising a central valve for connecting at least one of the pressure chambers formed between the rotor and the stator to the cavity in the segment of the stator.

10. An internal combustion engine comprising a combustion chamber, a crankshaft driven by the combustion chamber, a camshaft for controlling the combustion chamber, and a camshaft adjuster according to claim 8 for transmitting rotational energy from the crankshaft to the camshaft.

* * * * *